United States Patent [19]

Smith

[11] 4,408,915

[45] Oct. 11, 1983

[54] REVERSE TAB CONTROL SYSTEM FOR TYPEWRITERS

[75] Inventor: Michael H. Smith, New Milford, Conn.

[73] Assignee: SCM Corporation, New York, N.Y.

[21] Appl. No.: 293,747

[22] Filed: Aug. 17, 1981

[51] Int. Cl.[3] ..... B41J 25/18

[52] U.S. Cl. ..... 400/290; 400/479; 400/279

[58] Field of Search ..... 400/144.2, 279, 285.5, 400/290, 479

[56] References Cited

U.S. PATENT DOCUMENTS

| | | | |
|---|---|---|---|
| 2,723,019 | 11/1955 | Christian et al. | 400/290 X |
| 3,993,180 | 11/1976 | Locke | 400/290 X |
| 4,258,356 | 3/1981 | Jalbert | 400/479 X |

*Primary Examiner*—Ernest T. Wright, Jr.
*Attorney, Agent, or Firm*—Armand G. Guibert; Ernest F. Weinberger

[57] ABSTRACT

A typewriter has a Keyboard (12), including a Tab Set Key (22), a Tab Clear Key (24), and a Tab Actuating Key (26). Operation of the tab set key stores stop positions of the Carrier (18) with respect to the typewriter's Platen (14). Shallow depression of the tab actuating key causes the carrier to move forward (right) to the next tab stop position. A first deep depression of the tab actuating key establishes a Reverse Tab Mode causing the carrier to move backward (left) to the nearest preceding tab stop position and causing the platen to rotate (index) so as to position the Printing Element (16) one line down on the paper, thereby to facilitate typing the next line of single column material without effecting a carrier return and forward movement of the carrier to the beginning of the column. Each subsequent shallow depression of the tab actuating key causes the carrier to move backward to the next preceding tab stop position without indexing, thereby to facilitate typing the next line of multiple column material without effecting a carrier return and forward movements of the carrier. The Reverse Tab Mode can be ended by activating almost any other key, whereupon subsequent shallow depression of the tab key causes the carrier to move forward in normal fashion.

7 Claims, 6 Drawing Figures

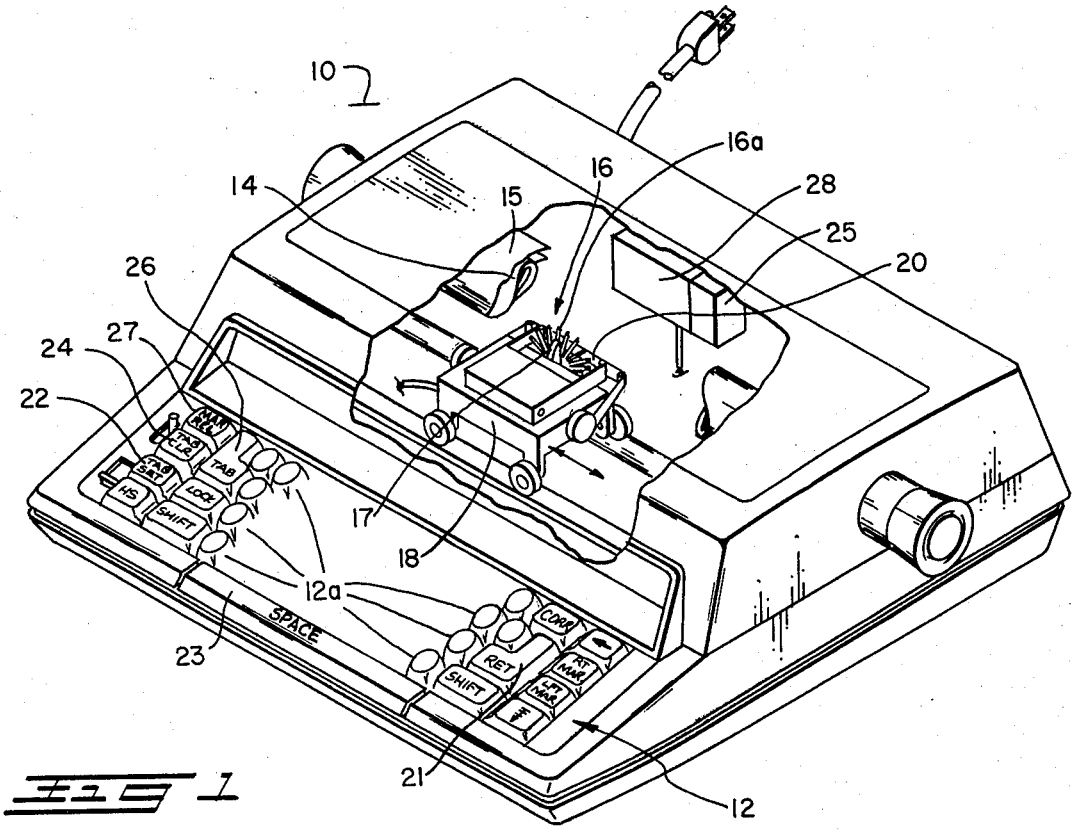
FIG 1
FIG 2
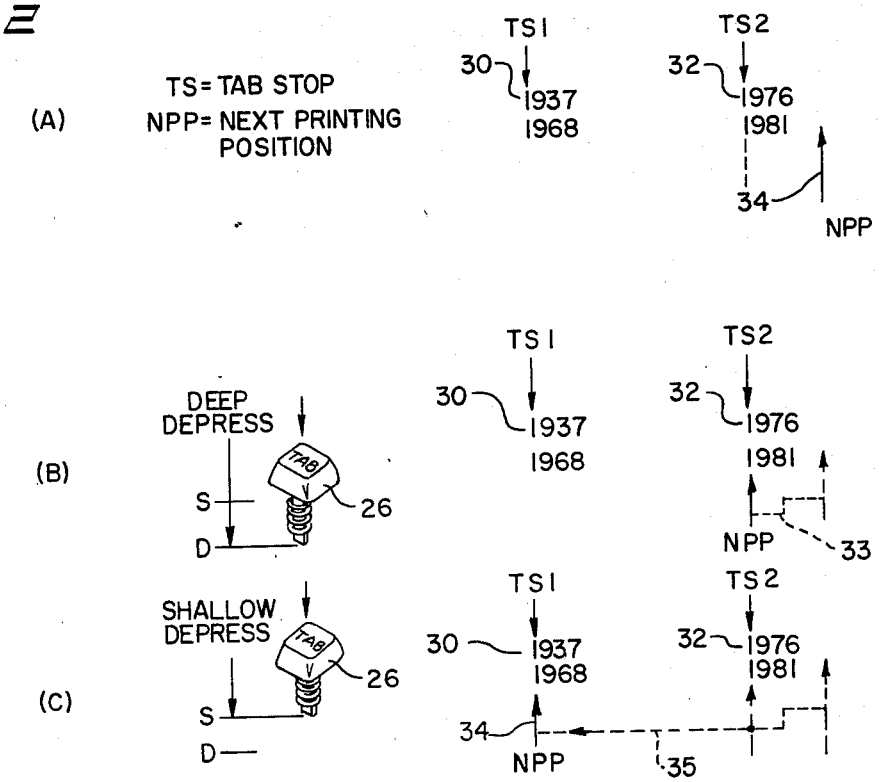

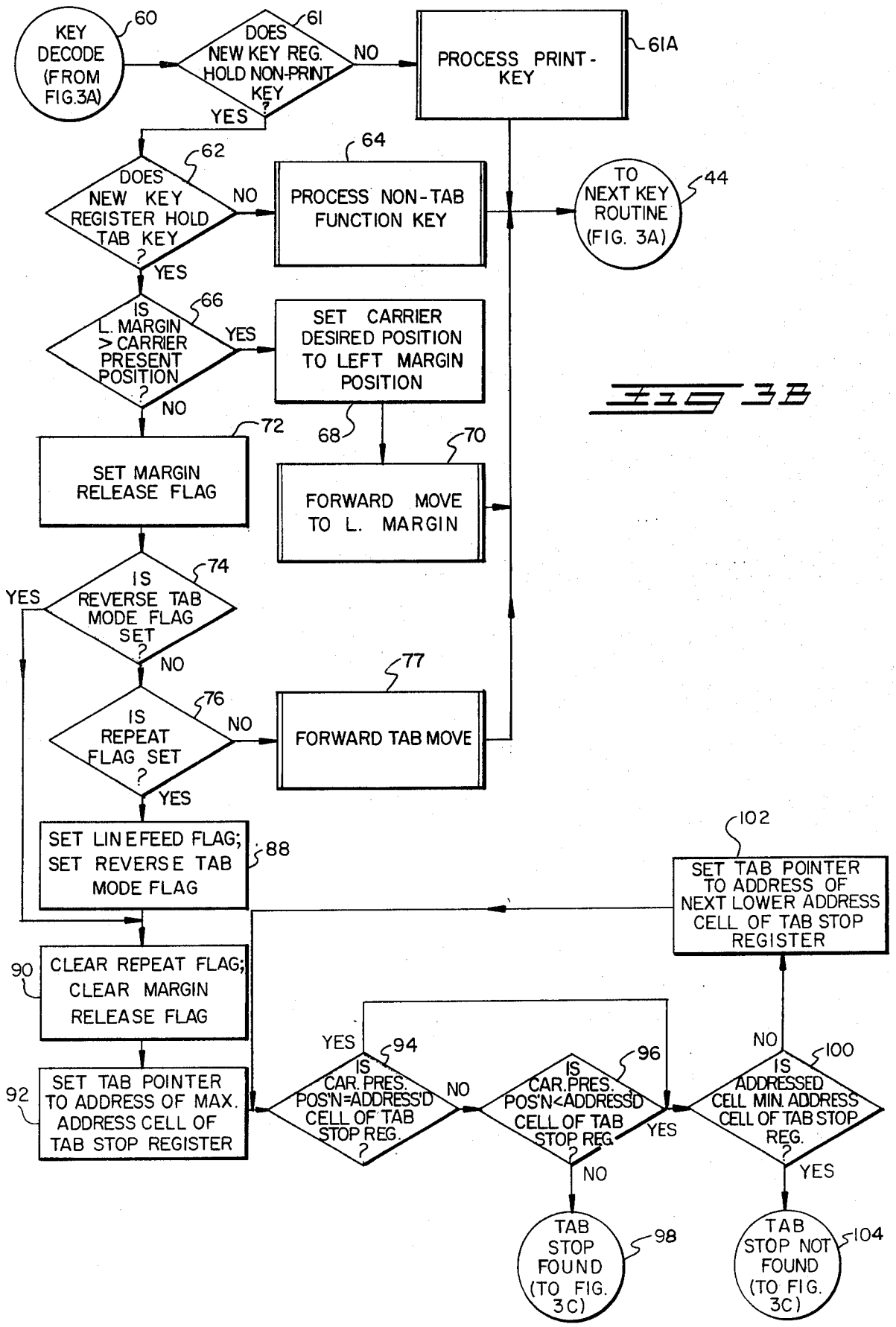
KEY DECODE (FROM FIG.3A)
60
DOES NEW KEY REG. HOLD NON-PRINT KEY ?
61
NO
YES
PROCESS PRINT-KEY
61A
DOES NEW KEY REGISTER HOLD TAB KEY ?
62
NO
YES
PROCESS NON-TAB FUNCTION KEY
64
TO NEXT KEY ROUTINE (FIG. 3A)
44
IS L. MARGIN > CARRIER PRESENT POSITION ?
66
YES
NO
SET CARRIER DESIRED POSITION TO LEFT MARGIN POSITION
68
FIG 3B
SET MARGIN RELEASE FLAG
72
FORWARD MOVE TO L. MARGIN
70
IS REVERSE TAB MODE FLAG SET ?
74
YES
NO
IS REPEAT FLAG SET ?
76
NO
YES
FORWARD TAB MOVE
77
SET LINEFEED FLAG; SET REVERSE TAB MODE FLAG
88
CLEAR REPEAT FLAG; CLEAR MARGIN RELEASE FLAG
90
SET TAB POINTER TO ADDRESS OF MAX. ADDRESS CELL OF TAB STOP REGISTER
92
IS CAR. PRES. POS'N=ADDRESS'D CELL OF TAB STOP REG. ?
94
YES
NO
IS CAR. PRES. POS'N<ADDRESS'D CELL OF TAB STOP REG. ?
96
YES
NO
IS ADDRESSED CELL MIN. ADDRESS CELL OF TAB STOP REG. ?
100
NO
YES
SET TAB POINTER TO ADDRESS OF NEXT LOWER ADDRESS CELL OF TAB STOP REGISTER
102
TAB STOP FOUND (TO FIG. 3C)
98
TAB STOP NOT FOUND (TO FIG. 3C)
104

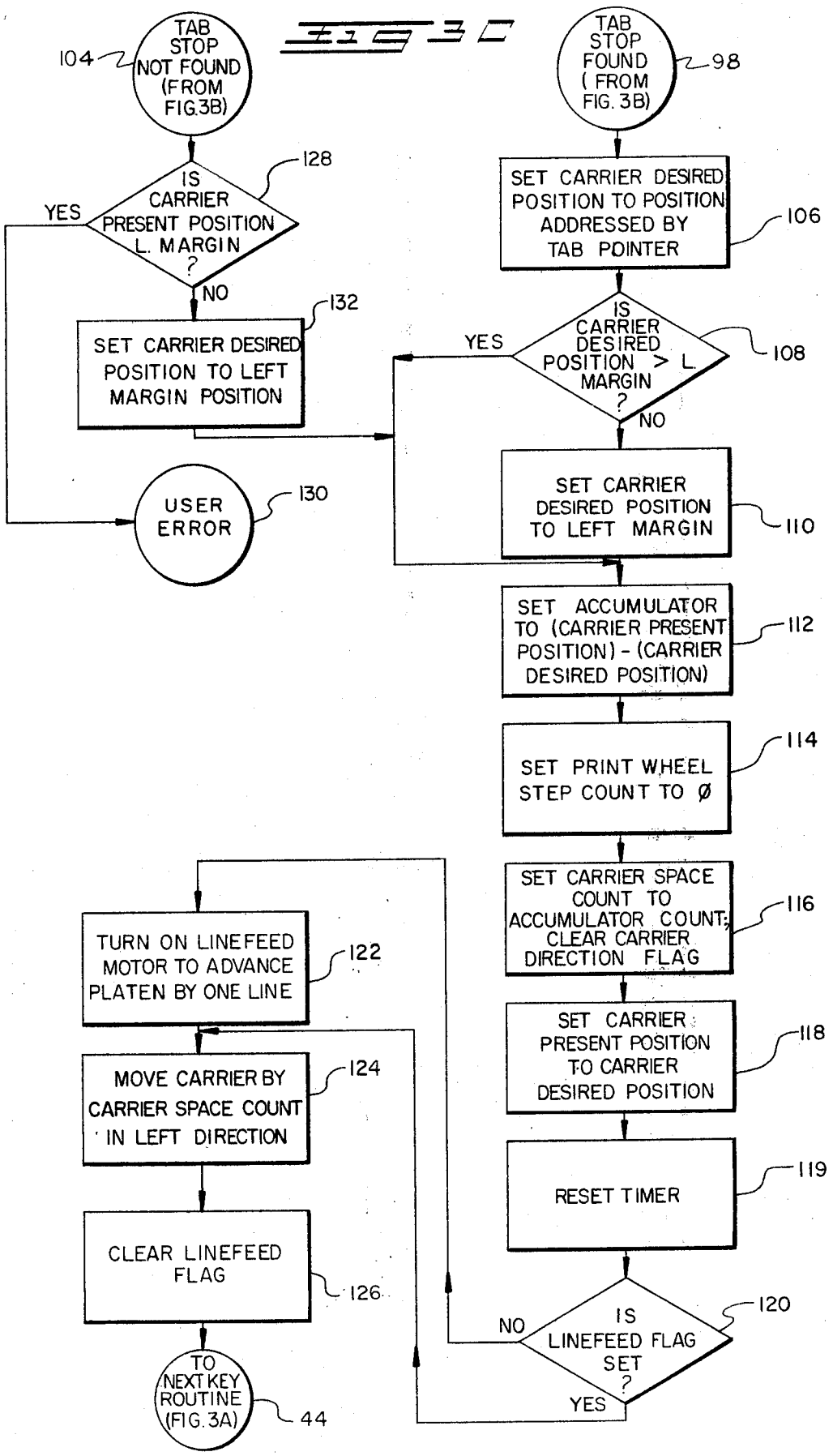
FIG 3C
TAB STOP NOT FOUND (FROM FIG.3B)
104
TAB STOP FOUND (FROM FIG. 3B)
98
IS CARRIER PRESENT POSITION L. MARGIN ?
128
YES
NO
SET CARRIER DESIRED POSITION TO LEFT MARGIN POSITION
132
USER ERROR
130
SET CARRIER DESIRED POSITION TO POSITION ADDRESSED BY TAB POINTER
106
IS CARRIER DESIRED POSITION > L. MARGIN ?
108
YES
NO
SET CARRIER DESIRED POSITION TO LEFT MARGIN
110
SET ACCUMULATOR TO (CARRIER PRESENT POSITION) - (CARRIER DESIRED POSITION)
112
SET PRINT WHEEL STEP COUNT TO Ø
114
SET CARRIER SPACE COUNT TO ACCUMULATOR COUNT; CLEAR CARRIER DIRECTION FLAG
116
SET CARRIER PRESENT POSITION TO CARRIER DESIRED POSITION
118
RESET TIMER
119
IS LINEFEED FLAG SET ?
120
NO
YES
TURN ON LINEFEED MOTOR TO ADVANCE PLATEN BY ONE LINE
122
MOVE CARRIER BY CARRIER SPACE COUNT IN LEFT DIRECTION
124
CLEAR LINEFEED FLAG
126
TO NEXT KEY ROUTINE (FIG. 3A)
44

REVERSE TAB CONTROL SYSTEM FOR TYPEWRITERS

CROSS REFERENCE TO RELATED APPLICATIONS

The following patent cases describe various other inventions which can be used concurrently with the present invention; these applications also detail various other aspects of the operation and construction of the typewriter discussed herein: application Ser. No. 853,778, filed Nov. 21, 1977, and U.S. Pat. No. 4,258,356, granted Mar. 24, 1981, both of Vincent P. Jalbert for Acoustic Keyboard Systems; application Ser. No. 246,820, filed Mar. 23, 1981, of Raymond T. Pajer and Pedro T. Guzman for Encoding Apparatus Utilizing Waves of Controlled Initial Polarity; application Ser. No. 317,038, filed Nov. 2, 1981, of Ray Blanchard for Encoding Apparatus having an Acoustic Member with Mirror-Image Tabs; application Ser. No. 259,722, filed May 1, 1981, for Halfspace Control System for Electronic Typewriter with Correction Register; application Ser. No. 311,473, filed Oct. 14, 1981, for Typewriter With Print And Correction Mechanisms on Movable Carrier Which Has Manual And Automatic Move Sequences, both of the present inventor, and application Ser. No. 254,034, filed Apr. 14,1981, of Hans W. Mueller et al. for "Line-spacing Apparatus", now U.S. Pat. 4,365,904, granted Dec. 28, 1982.

BACKGROUND OF INVENTION

1. Field of Invention

This invention relates to typewriters, particularly to a typewriter having tabulation (tab) controls. More particularly it relates to such typewriter wherein reverse as well as forward tab capabilities are provided.

2. Description of Prior Art

Heretofore most typewriters contained tab controls for rapidly and automatically adjusting the relative positions of the printing mechanism (type bars or print head) and the platen. In typewriters with fixed print heads or typebars, the platen was moved with respect to printing mechanism, and in typewriters with fixed platens, the printing head (a ball or a spoked and rimless "daisy" wheel) was moved with respect to the platen. For purposes of facilitating discussion, the operation will be detailed with reference to the latter type of machine (the print head moves and the platen is fixed), but the former type of machine (print mechanism is fixed and platen moves) should also be considered as an included method of tab operation.

The tab feature is useful for enabling a typist to effect rapid and repetitive movements of the printing mechanism to a plurality of different horizontal positions along a line on the paper or other recording web. In mechanical typewriters, the tab stop positions were usually stored by positioning mechanical pawls to stop movement of the platen at spaced horizontal locations, where desired. In electronic typewriters, the output of the keyboard consists of electronic signals which are processed in an electronic data processing system within the typewriter to generate suitable control signals for driving solenoids and step- or servo-motors to cause the typing mechanism to print selected characters and effect other operations; here the tab stop positions usually were stored in an electronic memory and the carrier was moved to the tab stop positions by means of a servomechanism under control of the electronic data processing system.

In most typewriters, the tab system was of the forward type only, i.e., the tab mechanism was able to move the printing mechanism only to the right with respect to the platen. This is disadvantageous in situations where a typist must type, for example, a single column of characters. After typing a line of the column, to type the next line the typist must return the print head to the first character of the column. To do this, the typist must choose one of two awkward alternatives. The first alternative is to reset the left margin control to the first character of the column of characters before typing the column. However this is an awkward operation and the original margin must be located and restored when typing of the column is completed. Alternatively, the typist can effect a carrier return, causing the carrier to move all the way to the left, and thereafter repeat tab until the carrier advances to the desired position; this is also awkward and inefficient.

To avoid these drawbacks, typewriters recently have appeared with a reverse-tab capability. In these typewriters, when a reverse-tab key was pressed, or when the regular tab was actuated in a certain manner, different from the regular forward-tab method of actuation, the carrier would move to the left with respect to the platen, i.e., to the next tab stop at the left of its current position. The reverse-tab feature greatly facilitated typing of columnar material by eliminating the above drawbacks.

As an added feature, some typewriters have also provided an automatic line indexing or platen rotation feature upon operation of the reverse tab key. In this feature, when the reverse tab key was operated and the carrier moved to the left with respect to the platen, the platen would also index, i.e., rotate by an angle equivalent to one line space so as to cause the next line position on the paper to appear at the current typing position. This made it even easier to type columnar material since it eliminated the need for the typist to manually advance to the next line space after a reverse-tab operation.

However the above combination of indexing or line spacing with reverse tab was disadvantageous when several columns of material were being typed since this requires that the carrier be moved to a second or even further-left column from a current typing position after each line is typed. The typist was not able to do this easily by repetitively reverse tabbing because every reverse-tab also caused an index; thus the correct position for typing the next line would be lost upon the second reverse-tab actuation. Thus in order to effect a reverse-tab movement to a second or subsequent column, the typist had to repetitively reverse tab to the desired column and thereafter adjust the platen so that the correct line on the paper was at the printing position. Alternatively, the typist could still effect a carrier return to the left margin and then forward tab to the desired column. However this did not take advantage of the machine's reverse-tab capability and was also difficult and time consuming.

Accordingly, one object of the present invention is to provide a typewriter with a reverse-tab feature whereby reverse-tab operation to the second or further columns of typing material to the left of the current position can be effected without adjusting the platen. Another object is to provide such a typewriter with a more efficient reverse-tab operating sequence. A further object is to provide an electronic typewriter with a novel reverse-tab operating feature. Still further objects and advantages will become apparent from a consideration of the ensuing description and the accompanying drawing.

DRAWING

FIG. 1 illustrates an electronic typewriter according to the invention.

FIGS. 2A, 2B and 2C are diagrammatic illustrations of a sequence of reverse tab operations according to the invention.

Figure 3A:
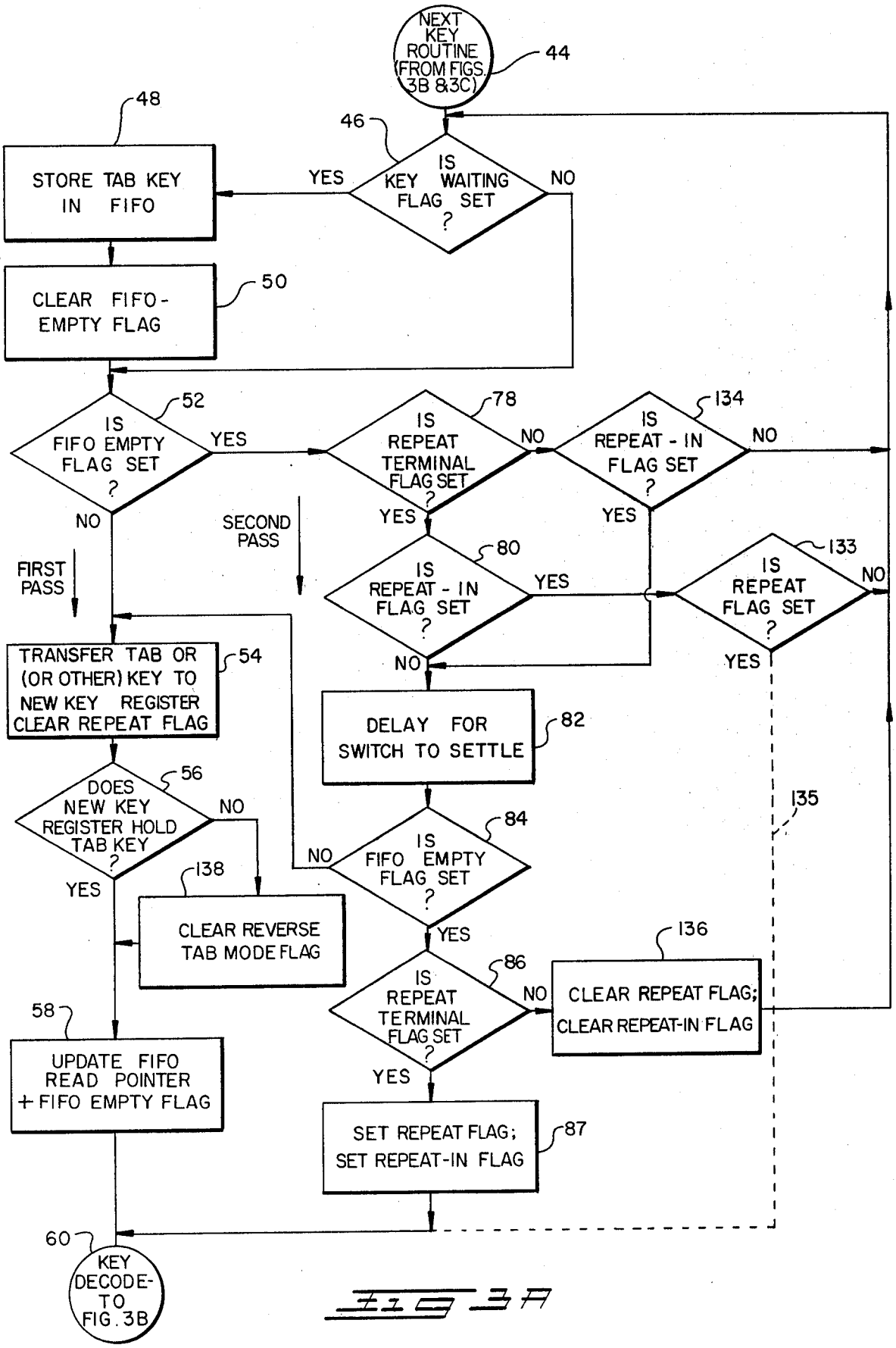

FIGS. 3A, 3B, and 3C are a three-part flow chart showing the sequence of reverse tab operations according to the invention.

Figure 4:
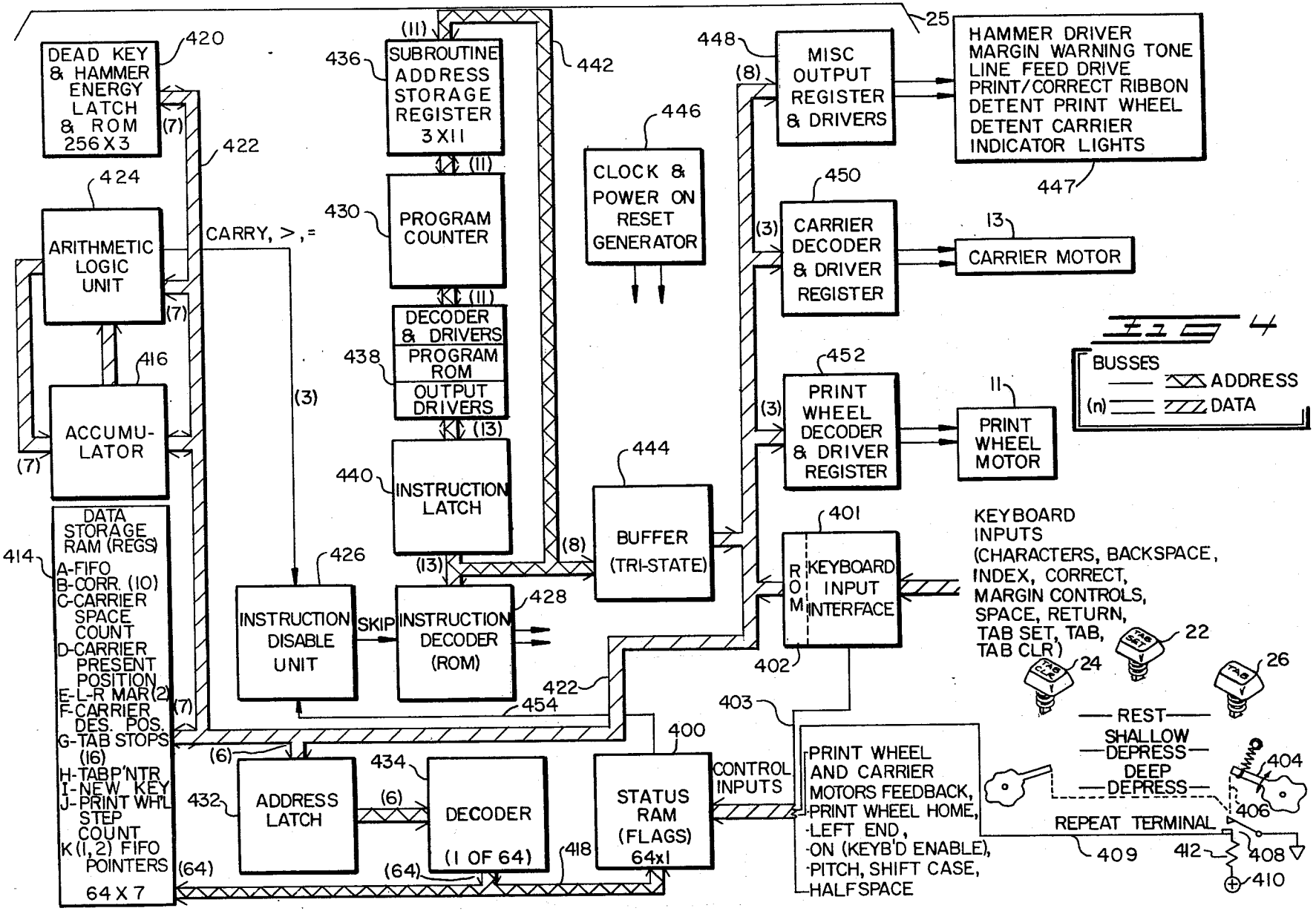

FIG. 4 is a block diagram of an electronic system used in the typewriter of the invention.

FIG. 1—ELECTRONIC TYPEWRITER

In FIG. 1, an Electronic Typewriter 10 according to the invention comprises the usual Keyboard 12, Platen 14, Print Wheel 16, and Movable Carrier 18 for Wheel 16. Print Wheel 16 is a common spoked and rimless print or "daisy" wheel: it has a plurality of radial spokes or petals 16*a*, each containing a respective character of keyboard 12. When any character is typed, Wheel 16 is rotated so that the desired character petal 16*a* is upright and then a hammer 17 strikes such petal 16*a* over an inked carbonned ribbon 20 onto a paper or other writing medium 15 which is fed over Platen 14.

Keyboard 12 contains the usual character keys 12*a* and control function keys, e.g., Carrier Return Key 21, Margin Release Key 27, etc; and also contains the following function keys of particular interest: a Tab Set Key 22, a Tab Clear Key 24, and a Tab Actuating (Tab) Key 26. Tab Clear Key 24 and Tab Key 26 are each depressible to either a shallow position or a deep position for purposes described subsequently. Typewriter 10 also includes a Control Circuit 28 which controls the functions and operations of Typewriter 10 in response to actuation of character and control keys on Keyboard 12. Principally, Circuit 28 controls the operation of Print Wheel 16, Platen 14, and Carrier 18.

More specifically, when a key 12*a* on Keyboard 12 representing a selected character is depressed, a unique electronic signal representing that key 12*a* will be coupled to Control Circuit 28 which will in turn generate appropriate signals to cause Print Wheel 16 to rotate so that a petal 16*a* thereof with the selected character is upright. Circuit 28 will also cause the hammer 17 to strike that petal 16*a* against Platen 14 via Print Ribbon 20 so as to imprint the character on the paper 15 and also move Carrier 18 to the right a distance equal to one character pitch or one space, either before or after the hammer 17 operates, so that each subsequent character will be typed one space to the right of the previous character.

FIG. 2—REVERSE TAB OPERATION

Prior to describing the reverse tab operation according to the invention, the forward and prior-art reverse tab modes of operation will be described in order to facilitate an understanding of the invention reverse tab operation.

Forward Tab

Referring to FIG. 2A, assume that a typist desired to type a plurality of columns on a paper, such as columns 30 and 32 indicated. Each column is composed of successive rows of four numbers each for purposes of example. The typist set the first tab stop (TS1) by moving Carrier 18 to the horizontal position indicated at "TS1" (Tab Stop 1) and thereafter depressed Tab Set Key 22. A tab stop was thereupon set for printing at this position by storing a corresponding position value in a memory register in known fashion, but detailed subsequently. Then Carrier 18 was moved to position TS2, the position of the first character in column 32. The typist again depressed Tab Set Key 22, thereby setting in similar fashion a second tab stop (TS2) at this position. Thereafter to type columns 30 and 32, the typist first pressed Tab Key 26 to cause Carrier 18 to move immediately and continuously from any position left of column 30 to TS1, the carrier stop position for printing the first character in column 30. After the characters of the first row of column 30 were typed, the typist again depressed Tab Key 26 to effect an immediate and continuous movement of Carrier 18 to TS2, the carrier stop position for printing the first character in column 32.

The typist then pushed the carrier return key 21, causing Carrier 18 to move to the left margin, which would be somewhere to the left of position TS1, and also causing the platen 14 to rotate one line space so as to move the paper 15 up one line. Carrier 18 was now in position to print the second line of columns 30 and 32. The typist again depressed Tab Key 26 to move Carrier 18 to position TS1, typed the second row of column 30, pushed Tab Key 26 again to move Carrier 18 to position TS2, and then typed the characters in the second row of column 32. Thereafter the Carrier 18 was in position to print in the next character space to the right of the last character ("1") of the second row of column 32, as indicated by the next print position (NPP) indicator arrow 34.

Prior Art Reverse Tab

If the typist were typing only a single column, such as column 32, and typewriter 10 had the prior-art reverse-tab-with-index capability, the typist was able to return the carrier 18 to position TS2 and move the paper 15 to the next line, as indicated by path 33 in FIG. 2B, by either depressing Tab Key 26 to a deep position (D) rather than the usual shallow position (S), or by actuating a separate reverse tab key (not shown), separation of functions being an obvious alternative. Carrier 18 automatically moved backward continuously or repeatedly backspaced to the next left tab stop position (TS2), and Platen 14 rotated one line (or several lines if line spacing was so set), so that the print position indicator arrow 34 moved to the left and down (line 36), to a position one line under the first character in the second row of column 32. Thus a third row of characters (not shown) could be typed in column 32 without returning Carrier 18 to the left margin and the forward tabbing one or more times in order to move Carrier 18 to position TS2 and one line below the last line typed.

However, if the typist were typing two or more columns, it was not possible, using the prior-art reverse tab with index feature, to move Carrier 18 easily to the first character position in the third row of first column 30 since each subsequent reverse-tab operation would cause Platen 14 to index, so that the print position indicator would move to the fourth line position (not shown) of column 30, thus requiring additional adjustments of Platen 14, or non-use of the reverse-tab feature when plural columns were being typed.

Reverse Tab Acccording to Invention

As indicated in FIG. 2C at 35, if Tab Key 26 is shallow depressed after the first deep depression thereof, Carrier 18 will still move leftward to the next left tab stop position TS1 but Platen 14 will not rotate. Thus the next print position indicator arrow 34 will be in the correct position to type the next row in column 30—i.e., one line under the first character in the second row as shown. Hence, a typist could effect proper reverse movements of Carrier 18 very easily when typing two columns by merely depressing Tab Key 26 twice, the first depression being a deep depression, thereby moving Carrier 18 back to TS1 and one line down. If more than two columns are being typed, the typist need merely depress Tab Key 26 a sufficient number of additional times to reach the first column being typed. The correct line and tab stop will automatically be reached at any column without the need to effect a carrier return or rotate Platen 14 in a separate operation.

The reverse tab moves have been described in the foregoing paragraphs and illustrated in FIGS. 2B and 2C (by broken lines 33 and 35) as occurring directly upon a deep depression of Tab Key 26. However, in actuality, in a current commercial embodiment of the invention, any depression of Tab Key 26 (shallow or deep) will cause a forward tab move (if possible) which begins immediately. If the depression of Key 26 is a deep one, after completing the forward tab move the reverse tab moves described and illustrated will be executed, i.e., Carrier 18 will move directly back to and through its position at the start of the forward move. The overall results being the same, the forward tab move and the corresponding return part of the reverse tab moves have not been illustrated in FIGS. 2B and 2C in order to simplify the drawing.

To review, according to the invention a deep depression of Tab Key 26 will effect a movement of Carrier 18 ending at the next preceding tab stop position (to the left), coupled with a rotation of Platen 14 to the next line. Each subsequent shallow depression of Tab Key 26 will move Carrier 18 to the next left tab position, without rotating Platen 14. (Subsequent deep depressions of Tab Key 26 will cause Carrier 18 to move two tab stops to the left, without a platen rotation. This operation is not described infra for purposes of facilitation of explanation.)

The normal mode of operation upon a shallow depression of Tab Key 26 is a forward (rightward) movement of Carrier 18 to the next tab stop. This normal mode can be restored (after any reverse movement due to a deep depression of Tab Key 26) by operating any character key 12*a*, the space bar 23, or almost any other function key e.g., carrier return key 21.

FIGS. 3A and 3B—FLOW CHART

FIGS. 3A and 3B depict the various operations which occur within Control Circuit 28 to effect the reverse tab mode of operation. The various blocks within FIGS. 3A and 3B depict individual operations which occur within Control Circuit 28 and the order of progression of the blocks depicts the sequence of these operations, in accordance with well-known flow chart usage. Control Circuit 28 includes a microprocessor 25 (FIG. 4) which, in accordance with the usual practice, makes continuous repetitive checks or interrogations of various conditions in the machine and, depending upon the state of such conditions, initiates or skips appropriate subroutines. The flow chart illustrates operations relevant to a subroutine initiated when Circuit 28 detects that Tab Key 26 (FIG. 1) has been depressed.

FIG. 3A—First Pass—Reverse Tab Key Entry

The reverse tab mode is initiated when Key 26 is deeply depressed. Two things thereupon occur to effect a Reverse Tab Key Entry, as will now be discussed.

Deep depression of Key 26 causes a Key Waiting Flag and Repeat Terminal Flag to be set. These flags correspond to binary cells in a memory array or Status RAM 400 of FIG. 4 (described infra) which indicate the status of various conditions or components of the machine. Depression of any key on Keyboard 12 causes the Key Waiting Flag to be set directly by a signal on an output line 403, indicating depression of a key (generally) on Keyboard 12. Also, information corresponding to the identity of the key depressed is provided at the output of a keyboard Encoder or ROM 402 of FIG. 4 (described infra and forming part of a keyboard Input Interface 401). Deep depression of Tab Key 26 moves a common bail 404 (FIG. 4), activating a mechanical coupling 406 which will in turn close a single-pole-single-throw momentary switch 408. This will ground and activate a Repeat Terminal input lead 409 connected directly to a Repeat Terminal stage or flag in Status RAM 400 which is immediately set, as a result. Normally the Repeat Terminal input lead 409 of RAM 400 is biased at a positive voltage (non-activating) by Positive Source 410 and Resistor 412. The Repeat Terminal input is used since it is a convenient method of effecting two modes of operation (forward and reverse tab) with a single Tab Key 26.

Box 44—Prior to describing the first operation, it will be noted here that the above-mentioned flags are periodically checked or interrogated, part of a routine identified by a circular (connector) box 44, labeled "Next Key Routine." Normally, Control Circuit 28 is in this idling routine in which interrogations of various flags or conditions in Status RAM 400 are made. These will not be listed here except insofar far as relevant. After completing any operation, the machine returns to its idling routine so that Box 44 represents a significant point in the flow chart.

Box 46—In its idling routine, Control Circuit 28 checks the Key Waiting Flag in RAM 400, as indicated by diamond (decision) Box 46. Since the Key Waiting Flag has been set, as described above, the Yes output of Box 46 will be followed.

Box 48—Next, in response to the presence of the Key Waiting Flag, a data number (code) representing depression of Tab Key 26 and provided at the output of ROM 402, will be read and stored in a First-In-First-Out (FIFO) Register which is Register A in a Data Storage RAM 414, described infra. The Key Waiting Flag will be cleared at the time of read out.

Box 50—To indicate that FIFO Register 414A is occupied, a FIFO-Empty Flag in Status RAM 400 is cleared, as shown by Box 50.

Box 52—Next, as indicated by this Box 52, the FIFO-Empty stage of Status RAM 400 will be interrogated. Since this stage was just cleared in the operation of Box 50, the No output of Box 52 will be followed.

Box 54—Since testing of the FIFO-Empty Flag has shown that there is at least one Key (code) stored in FIFO Register 414A (Box 52), the next key in FIFO Register 414A, regardless of its identity, will be transferred to a New Key Register 414I; the oldest and each succeeding Key code will be successively transferred, identified, and processed. Thus, in its turn, the Tab Key data code will be transferred from FIFO Register 414A, via an Accumulator 416, to New Key Register 414I, as indicated in Box 54. Also, a Repeat flag in Status RAM 400 will be cleared if set. The Repeat flag differs from the Repeat Terminal Flag which was set by deep depression of Tab Key 26, and is used to cause the machine to perform the Repeat function. The Repeat Terminal Flag merely indicates that the Repeat Terminal of RAM 400 has been activated, i.e., Switch 408 has been closed.

Box 56—Next a determination is made in Box 56 as to whether the data transferred to New Key Register 414I represents the Tab Key 26. The determination in Box 56 is made to determine if the reverse tab mode should be cleared if the tab key code is not present in New Key Register 414I, as more fully discussed below.

Box 58—Next, as indicated in Box 58, a two-part FIFO-pointer Register 414K having a first part 414K1 controlling the order of information readout from FIFO Register 414A, is updated to account for the transfer that occurred in Box 54. Another part of the FIFO-pointer register 414K2 controls the position of Register 414A at which input information is stored. The address information in these two parts of Register 414K controls the state of the FIFO-Empty Flag in Status RAM 400. If that information is identical, FIFO Register 414A is empty and the FIFO-Empty Flag is set, but is cleared upon a subsequent key-entry. Thus, as part of Box 58 the pointer contents are compared in known fashion and the FIFO-Empty Flag updated accordingly.

Box 60—Other preliminary operations, not relevant to the Reverse Tab operation, are made after Box 58, where the flow chart route for the actual Tab routine begins, as indicated generally by the Key Decode Connector Box 60 at the bottom of FIG. 3A, Part I and at the top of FIG. 3B, Part II of the Flow Chart. The Key Decode includes segregation of function codes in known fashion.

Box 61—The next operation and the first of FIG. 3B, indicated in this box (61), is one of the routine checks or interrogations performed by Circuit 28. This operation is a decision which determines whether the Key Code in New Key Register 414I is a non-print key i.e., the space bar 23 or one of the function keys 21, 22, 24, etc. If not, this indicates that the Key Code represents a printable character, so that the No output is followed and the printable Key Code is processed, as indicated in predefined process Box 61A. Since Tab Key 26 is a non-printable or "function" Key, the Yes output is followed to Box 62. (In actuality, the decision of Box 61 determines whether the Key Code is greater than 91 since all printable Key codes have values less than 92 and all function Key codes have values greater than 91.)

Box 62—The operation indicated is also one of the routine interrogations performed by Circuiit 28. This operation is a decision which determines whether a function Key code found to be in the New Key Register 414I is the Tab Key code. If not, the No output of Box 62 will be followed and, as indicated by Box 64, further tests to identify and process the function code are performed, but are not relevant here. If the key to be processed is Tab Key 26, the Yes output of Box 62 will be followed to Box 66.

Box 66—Here, Circuit 28 determines whether the left margin setting (a stored count of a number of spaces from the left end of Platen 14, which count is initially preset automatically or otherwise programmed by the typist) is greater than the carrier's present position, i.e., is the number of spaces from the left end of Platen 14 to the left margin greater than the number of spaces from the left end to the present position of Carrier 18? If the left margin setting is greater than the carrier's present position, Carrier 18 is outside the usual test area—in other words, to the left of the left margin—and the Yes output of Box 66 will be followed, but if Carrier 18 is to the right of the left margin, the No output of Box 66 will be followed.

Box 68—Assuming Carrier 18 is to the left of the left margin so that the Yes output of Box 68 is followed, the next operation, illustrated by Box 68, is to set a Carrier Desired Position Register 414F to the stored value for the left margin position. Thereafter, as illustrated by Box 70, the machine makes a forward (rightward) move to the left margin.

When the position of Carrier 18 is to the left of the left margin, actuation of Tab Key 26 will cause Carrier 18 to move rightward to the left margin, and no reverse move will take place, even if Tab Key 26 is deeply depressed, any tab stops set to the left of the left margin being ignored. This mode of operation is provided as it would be an undesirable and probably mistaken mode of operation to try to move Carrier 18 to any tab stops which might be set outside the left margin.

Box 44 Bis—After the forward move to the left margin (Box 70) the machine returns to its normal idling procedure or Next Key Routine, as illustrated by connector Box 44 of FIG. 3B, which connects to Box 44 of FIG. 3A. The machine will follow the flow chart and ultimately reach connector Box 130 of FIG. 3C, in which a user error indication is provided. This sequence will not be detailed.

Box 72—If the decision in Box 66 is No, i.e., Carrier 18 is not to the left of the left margin, the next step is to set a Margin Release Flag, as indicated in Box 72. Setting a Margin Release Flag involves setting another of the previously-mentioned binary cells (not shown) of Status RAM 400 to a certain state which will enable forward tab moves to be made to and to the right of the right margin without operating the margin release key 27.

Box 74—The next step, illustrated by Box 74, is to determine whether the Reverse Tab Mode Flag has been set. The Reverse Tab Mode Flag, also in Status RAM 400, is set after the reverse tab mode had been entered. If Tab Key 26 has been deep-depressed for the first time, the machine will not yet be in the Reverse Tab mode so that the Reverse Tab Mode Flag will not have been set and the No output of Box 74 will be followed. However, if the machine has previously entered the Reverse Tab mode, the flag will be in the set state and the Yes output of Box 74 will be followed.

Box 76—Since the Reverse Tab Mode Flag has not yet been set, the No output of Box 74 is followed. The next operation is a decision (Box 76) to see if the Repeat Flag has been set. Since only the Repeat Terminal Flag has been set thus far (as discussed in the paragraph preceding Box 44), the No output of Box 76 will be followed to Box 77.

Box 77—A forward tab move is then executed, as indicated in Box 77, to the next tab stop to the right of the carrier's present position, or if there is no such tab stop, Carrier 18 will proceed to the right margin. When the forward tab move is completed, the machine has completed its first pass of the flow chart and continues to the Next Key Routine, as indicated by Box 44, which connects with that same Box at the top of FIG. 3A.

FIG. 3A—Second Pass—Repeat Flag Tests

Box 46 Bis—Returning to FIG. 3A, where the operations continue at the output of Box 44, the second pass through FIG. 3 Part I of the flow chart is made, this time for performing various Repeat Flag tests. A decision is again made in Box 46 as to whether the Key Waiting Flag has been set. The Key Waiting Flag is no longer set, since the Tab Key code awaiting entry was delivered from ROM 402 to the FIFO Register 414A (Box 48) at which time the Key Waiting Flag was reset, as mentioned earlier; and providing the typist has not depressed further keys, as will be assumed for purposes of this description; so that the No output of Box 46 is followed to Box 52.

Box 52 Bis—Again the FIFO-Empty Flag is checked in Box 52, but this time the decision will be Yes, since Tab Key 26 was transferred from the FIFO Register 414A in Box 54 and the empty flag was set in Box 58.

Box 78—Next, as indicated, the Repeat Terminal Flag in Status RAM 400 is checked. This flag was already set as previously described in the introductory remarks concerning FIG. 3A of the Flow Chart, so that the Yes output of Box 78 will be followed. Note that this flag can only be cleared upon the typist's release of the deep-depressed Tab Key 26.

Box 80—The Repeat-In Flag is then checked. This flag is set when the Repeat Terminal Flag has been recognized and processed. Since this has not yet been done, the decision in Box 80 will be No.

Box 82—A short delay (20 ms) is provided in Box 82 to allow termination of any transients resulting from deep depression of Tab Key 26 and activation of Switch 408, thereby to prevent false triggering.

Box 84—The FIFO-Empty Flag is next checked. Since this flag is now set, as explained in the second discussion of Box 52 above, the Yes output is followed.

Box 86—A check is again made of the Repeat Terminal Flag. As explained above in the discussion of Box 78, this flag is still set, so the Yes output is followed. If not set after the delay of Box 82, this indicates the Repeat Terminal Flag seen in Box 78 was caused by an unwanted transient signal.

Box 87—Next, the Repeat Flag (indicating the machine should repeat the key in the New Key Register 414I) is set and the Repeat-In Flag (indicating that the Repeat Terminal Flag has been recognized) is also set.

The sequence then proceeds again through connector Box 60 to Part II of the flow chart in FIG. 3B through Box 62 (Yes), Box 66 (No), Box 72, Box 74 (No) to Box 76 again.

FIG. 3B—Reverse Tab Entry

Box 76 Bis—The Repeat Flag has just been set in Box 87, so that the Yet output is followed on the second pass through Box 76, whereupon actual entry of the Reverse Tab Mode is begun.

Box 88—The next step (Box 88) is to set a Line Feed Flag and a Reverse Tab Mode Flag (both also in Status RAM 400) to indicate that upon the next execution of a mechanical operation, a line feed (rotation) of Platen 14 and a reverse tab operation should both be effected.

Returning to Box 74, if the Reverse Tab Mode Flag were already set at the time of the decision in Box 74, the Yes output of Box 74 would be followed to the output of Box 88. This path is taken when the machine is already in the Reverse Tab mode, in which case the decision of Box 76 and the flag setting of Box 88 would not be appropriate. The Reverse Tab Flag would already be set and the Line Feed Flag should not be set since a line feed is desired only upon the first reverse tab move and according to one main aspect of the invention is omitted thereafter.

Box 90—Next, the Repeat Flag (in Status RAM 400) is cleared, as indicated in this box, in order to prevent continuously repeated reverse tab operations. Also the Margin Release Flag, set in Box 72, will be cleared to prevent any moves through the margins on subsequent key inputs.

Locating Tab Stop

Box 92—Next, as illustrated in Box 92, a Tab Pointer Register, which is present as Register H of Data Storage RAM 414 (FIG. 4 ), is set to address the highest address cell in a Tab Stop Register (Register G of RAM 414). The Tab Stop Register 414G stores the positions or "Stops " along Platen 14 to which Carrier 18 will advance on tab moves. Tab Stop Register 414G has, in the present embodiment, sixteen seven-bit cells for storing previously set tab stops (from left to right) along the printing line. In the operation of Box 92, the tab pointer is set to address the highest-address cell in Register 414G, i.e., the cell which would store the rightmost tab position if all sixteen possible tab stops were set.

More particularly, when tab settings are made, they are supplied to the sixteen cells of Tab Stop Register 414G in order of their numbered space positions along Platen 14, with the leftmost tab stop setting being supplied to the cell with the lowest address in Register 414G, the next left tab stop setting to the cell with the next higher address, and so on. If less than the sixteen possible tab stops are set, the cells without a tab stop will automatically be supplied with a reading of 127, which is at least one higher than the maximum tab stop setting position possible for a machine set to 12-pitch (12 characters per horizontal inch) and having a writing line of 10.5 inches. In Box 92, Tab Pointer Register 414H is set to address the cell with the highest possible address as a first step in locating the closest tab stop to the left of Carrier 18. The tab stop cells are addressed and checked in reverse order, from highest address to lowest, in order to locate such closest-left tab stop.

Box 94—Next, as indicated, a comparison is made to determine whether the carrier's present position (stored in a Carrier Present Position Register 414D) equals the setting in the cell addressed by the Tab Pointer Register 414H. If the decision is Yes, the currently-addressed cell, which is the maximum-address cell of Tab Stop Register 414G, contains a valid carrier stop setting (less than 127 for a machine set to 12-pitch), indicating that all sixteen possible carrier stop settings have been made, and Carrier 18 is presently at that stop setting, which is the rightmost tab stop. If the decision is No, there was either no tab setting in the maximum-address cell, i.e., the maximum-address cell is set to an impossible carrier Position (127) or Carrier 18 is to either side of the setting in the maximum-address cell.

Box 96—Assuming the No output of box 94 is followed, i.e., Carrier 18 is to either side of the setting of the maximum-address cell or there is no tab stop in the maximum-address cell, a comparison will next be made (Box 96) to determine whether the carrier's present position is less than the setting in the cell addressed by the Tab Pointer Register 414H, which is ,till the maximum-address cell. If the decision is No, Carrier 18 is to the right of the position in the addressed cell, which cell has been set with a valid carrier position. Therefore, as indicated by connection Box 98, the closest tab stop to the left of Carrier 18 has been found.

If the decision in Box 96 is Yes, i.e., the carrier's present position is less than the position in the cell addressed by the Tab Pointer Register 414H, this indicates that Carrier 18 is somewhere to the left of the maximum tab stop setting in the Tab Stop Register 414G.

Box 100—Assuming Carrier 18 is to the left of the setting in the cell addressed by the Tab Pointer Register 414H (Yes from Box 98), or if the carrier's present position is equal to the position in the cell addressed (Yes from Box 94), next a decision will be made (Box 100) to determine whether Tab Pointer is addressing the minimum-address cell of the Tab Stop Register 414G. In the present round the Tab Pointer could not be at such minimum-address cell since it has just been set to the maximum-address cell (Box 92), so that the No output of Box 100 must be followed.

Box 102—When the No output of Box 100 is followed, as indicated in Box 102, Tab Pointer Register 414H will be set to address the next-lower address cell of the Tab Stop Register 414G. In other words, the Tab Pointer Register 414 H is decremented to address the next lower possible tab setting position.

Box 94 Bis—Next, the output of Box 102 (on the left side thereof) is followed back up to decision Box 94, where again a determination is made as to whether the setting in Carrier Present Position Register 414D is equal to setting of the cell in Tab Stop Register currently addressed by Tab Pointer Register 414H, which in the present round is the cell with the next-to-highest address.

Box 96 Bis—If the decision in Box 94 is No, a comparison is again made (Box 96) to see whether the setting in the Carrier Present Position Register 414D is less than that in the addressed cell. If the decision in Box 96 is No, the setting in the cell addressed by the Tab Pointer Register 414H is now established to be the closest tab position left of Carrier 18, as indicated by Box 98.

Box 100 Bis—Returning to Box 94, if the setting in the Carrier Present Position Register 414D equals the setting in the cell addressed by the Tab Pointer Register, the Yes output from Box 94 will be followed, and a determination will be made (Box 100) as to whether Tab Pointer Register 414H is addressing the minimum address cell of the Tab Stop Register 414G. If so, the Yes output of Box 100 will now be followed, indicating that all possible tab set positions have been surveyed and (Box 104) no tab to the left of Carrier 18 was found.

Box 102 Bis—If the decision in Box 100 is No, i.e., the tab pointer is not addressing the minimum position of the Tab Stop Register 414G, the tab pointer is again decremented (Box 102) and the decisions in Box 94, 96, and possibly Box 100 are made, as before.

Tab Stop Found

Box 106—If a tab stop position to the left of Carrier 18 was found (Box 96), a connection is made (Box 98) to FIG. 3C where the next operation (Box 106) is to set a Carrier Desired Position Register (414F) to the value in the cell addressed by Tab Pointer Register 414H. This is done in order to move Carrier 18 to the setting in the addressed cell of Tab Stop Register 414G.

Box 108—Next, a comparison is made (Box 108) to determine whether the setting in the Carrier Desired Position Register 414F is greater than that of the left margin. if so, this indicates that the Carrier Desired Position is inside the left margin, whereupon the Yes output of Box 108 will be followed. If the Carrier Desired Position Register 414F is not greater than the left margin, the No output of Box 108 will be followed, indicating that the desired tab stop is outside or to the left of the left margin. In this case it would not be desirable to move Carrier 18 further to the left.

Box 110—If the desired tab stop is outside the left margin, i.e., the No output of Box 108 is followed, next (Box 110) the Carrier Desired Position Register 414F is set to the left margin setting so that Carrier 18 will go to the left margin at the next move.

Box 112—After the Carrier Desired Position Register 414F is set to the left margin (Box 110), or if the Carrier Desired Position Register's setting is greater than the left margin (Yes from Box 108), Accumulator 416 is set (Box 112) to the difference between the setting of the Carrier Present Position Register 414D and that of the Carrier Desired Position Register 414F in order to indicate the number of spaces by which Carrier 18 must move to reach the desired position.

Box 114—Thereafter, a Print Wheel Step Count Register 414J (FIG. 4) is set to zero to prevent Carrier 18 from making a single letter space movement, which it might do if a number were set in Register 414J.

Box 116—The Carrier Space Count Register 414C is then set to the "number" or "value" in Accumulator 416. This is in preparation for movement of Carrier 18, which moves according to the setting in Carrier Space Count Register 414C.

Next (also Box 116), the Carrier Direction Flag (in Status RAM 400) is cleared. This flag is normally set to move Carrier 18 to the right and the clearing thereof is in preparation for a left or reverse move.

Box 118—Next, the value in Carrier Position Register 414D is set to the value in Carrier Desired Position Register 414F. This is done so that the Carrier Present Position Register 414D will store the carrier's actual position after the tab move is completed and so that Carrier 18 will return to this desired position if a machine or motor error occurs during carrier movement.

Box 119—A timer (not shown, but conventional) is preferably used to control (among other events, if desired) a Linefeed Motor (not shown, but any conventional unit is suitable, e.g., a "DC" motor) for rotating Platen 14. At this point, the timer is reset.

Box 120—A decision is made next as to whether the Linefeed Flag (in RAM 400) has been set. If Tab Key 26 has been deeply depressed—i.e., if the first reverse tab movement is being made—the Linefeed and Reverse Tab Mode Flags will have been set in Box 88. If the Reverse Tab Mode Flag was already set (Yes from Box 74)—i.e., a second or subsequent reverse tab move is being made—then Boxes 76 and 88 will be bypassed and consequently the Linefeed Flag will not have been set via Box 88.

Box 122—If the first reverse tab movement is being made, the Linefeed and Reverse Tab Flags will have been set in Box 88 so that a Yes decision will be made in Box 120 and (Box 122) rotation of Platen 14 one line ahead, in accordance with the invention, is started. Substantially at the same time, Carrier 18 will start its move (Box 124) in the left direction by the value in the Carrier Space Count Register 414C—i.e., to the next left tab stop.

If a second or subsequent reverse tab movement is being made, the Reverse Tab Flag will have been set so that a Yes decision in Box 74 will cause Box 88 to be bypassed and the Linefeed Flag, which is cleared at the end of the first reverse tab movement (see Box 126 below) will still be clear, so that a No decision will be made in Box 120. Accordingly, Box 122 is bypassed and only the carrier move (Box 124) to the next stop position at left is performed. The reverse move is then completed.

While a relatively large number of decisions and operations have been described as occurring between the Forward Tab Move (Box 77) and the Reverse Tab Move (Box 124), in actuality, due to the high clock rate of the machine, the Reverse Tab Move appears to occur substantially immediately after the Forward Tab Move.

Box 126—After completing the above moves, then, as shown in this box and in accordance with the invention, the Linefeed Flag, which was originally set in Box 88 upon entry into the Reverse Tab Mode, is cleared in order that subsequent shallow depressions of Tab Key 26 will effect a reverse tab move without a linefeed, as discussed supra.

Box 44 Bis—As seen from Box 126 the sequence returns to Box 44, the Next Key Routine, which includes Box 54 where the oldest Key Code in FIFO Register 414A is transferred to New Key Register 414I, via Accumulator 416. If Tab Key 26 has been depressed twice in succession, the Key transferred will be Tab Key 26 but, if not, the key will be a character, space or other key. Discussion of these circumstances will be undertaken subsequently.

Tab Stop Not Found

Box 128—Returning to Box 100 (FIG. 3B), if no tab to the left of Carrier 18 was found, a connection is made (Box 104) to FIG. 3C where a decision is then made (Box 128) as to whether Carrier 18 is presently at the left margin, i.e., is the setting in the Carrier Present Position Register 414D equal to the setting in the Left Margin Register 414E? If so, Carrier 18 cannot be moved to any tab stop position and the machine proceeds (Box 130) to the user error subroutine in which error lights (not shown, but conventional units among the indicator lights forming part of the Miscellaneous Outputs box 447 in FIG. 4) are flashed.

Box 132—If the carrier present position is not equal to the left margin position, the No decision output of Box 128 will be followed and the Carrier Desired Position Register 414F will be set (Box 132) to the value in the Left Margin Position Register (part of 414E) in order to move Carrier 18 to the left margin. Thereafter, the actual carrier movement is completed as indicated in Boxes 112 to 126.

Box 44 Bis—Whether or not a tab stop to the left of Carrier 18 is found, the Reverse Tab Movement procedure ends at Box 126, as seen above. From there the output is again followed back to Box 44 of FIG. 3A, at which point the machine resumes its normal idling or Next Key Routine.

FIG. 3A—Tab Key Held Deep Depressed

If the typist holds Tab Key 26 deeply depressed during and after the reverse tab move, only one such move will be made because of the sequence now followed in FIG. 3A.

Boxes 46 and 52—The Key Waiting Flag is not set since it was cleared upon delivery of the waiting Tab Key Code from ROM 402 to FIFO Register 414A, as explained supra, and the typist has not depressed a key other than Tab Key 26 (an erroneous action, as it would override the desired reverse tab operation.) Thus the No output of Box 46 is followed. The FIFO-Empty Flag is set, so the Yes output of Box 52 is also followed.

Boxes 78 and 80—The Repeat Terminal Flag is set since it is assumed that Tab Key 26 is being held deep-depressed. The Repeat-In Flag was set in Box 87 and was never cleared so the Yes output of Box 80 is also followed.

Box 133—The Repeat Flag is tested in Box 133. Since that flag was cleared in the reverse tab entry (Box 90), the No output of Box 133 is followed, back to the idling routine (Box 44). Thus no further reverse tab moves will occur, even if key 26 is held deep depressed. Note that the Yes output of Box 133 is not relevant to the instant invention, as indicated by dotted line 135 to Connector 60.

FIG. 3A—Tab Key Released

Box 134—When Tab Key 26 is released, the machine will follow the No output of Box 46, the Yes output of Box 52, the No output of Box 78 (the Repeat Terminal is no longer made active since Switch 408 will now be open, Bail 404 having been spring-returned to its initial position) to Box 134 where the Yes output is followed since the Repeat-In Flag, which was set in Box 87, was never cleared. The routine will proceed through box 82, follow the Yes output of Box 84 (the FIFO Register 414A is empty) and the No output of Box 86 (a flag check operation identical to that in Box 78) to Box 136.

Box 136—At this point, the Repeat and Repeat-In Flags are cleared and the machine returns to its idling routine.

FIG. 3A—Tab Key Pressed Again

After the first reverse tab move, which was accompanied by a linefeed, if the Tab Key 26 is pressed again but this time only shallowly, the machine will pursue the following route through the flow chart to effect a second reverse tab movement (path 35 of FIG. 2C): Yes from Box 46, Box 48, Box 50, No from Box 52, Box 54, Yes from Box 56, Box 58 to Box 60 in FIG. 3B, Yes from Box 62, No from Box 66, Box 72, Yes from Box 74 (the Reverse Tab Mode Flag, set in Box 88, was never cleared), through Boxes 90 to 98 and 106, 120, as described above. In Box 120, as stated, the No output will be followed since the Linefeed Flag was cleared in Box 126 on the first reverse tab movement, the result being that Carrier 18 will be moved (Box 124), but not Platen 14, in accordance with the invention.

FIG. 3A—Non-Tab Key Pressed

The Reverse Tab Mode can be exited by depressing a character key or almost any function key other than Tab Key 26. When this is done, the machine will proceed along the "First Pass" route of FIG. 3A to Box 56, the non-tab key being detected and the No output then followed to Box 138, where the Reverse Tab Mode Flag is cleared, thereby exiting the Reverse Tab Mode. The path then proceeds to Box 58 for update of the FIFO pointers before passing onward to Key Decode (connector Box 60) where the non-Tab Key is identified and processed in normal fashion, the details not being relevant here.

FIG. 4—BLOCK DIAGRAM OF HARDWARE

A block diagram of the electronic system of Control Circuit 28 to effect the operations in the flow chart of FIGS. 3A and 3B is shown in FIG. 4. In practice, all the components in Control Circuit 28 may be formed within a single integrated circuit or microprocessor chip. Appropriate amplification of output signals for driving the printing and other mechanisms will also be provided. In order to facilitate understanding, simplify the explanation, and avoid undue length, only the typewriter components relating to the invention and their ancillary components are detailed. Also only the most important inputs and outputs, data interconnections, and address interconnections of the invention components are shown in the block diagram of FIG. 4. Omitted are details of the other typewriter components and various ancillary circuits and lines to and from the components of the invention since their implementation is either shown in the above-referenced applications or is readily practicable by those skilled in the microprocessor or logic circuit design arts, given the flow chart of FIGS. 3A and 3B together with the block diagram of FIG. 4.

As indicated by the legend at right of FIG. 4, address busses (which generally carry information designating an "address" or location in a memory matrix) are designated by double lines interconnected by zig-zag lines, and data busses (which generally carry substantive information) are indicated by double lines interconnected by parallel slant lines. The numbers in parentheses adjacent various busses—e.g., "(7)"—indicate the number of lines or conductors in the bus. As is well known in the art, a seven-conductor bus can transmit data words or bytes of seven bits, and since each bit represents a digit in radix 2—i.e., the presence (ONE bit) or absence (ZERO bit) of successive powers of two in a summed progression from $2^0$ to $2^6$—such a bus can transmit decimal numbers (radix 10) up to 127.

A Keyboard Interface Unit 401 receives inputs directly from Keyboard 12; these include inputs designating selected characters, index (linefeed), a backspace input, a correct input, a tab set (Key 22), a tab clear (Key 24), a tab activate (Key 26), margin controls, space (Key 23), and return (Key 21), as indicated.

Preferably Keyboard 12 employs an acoustic sending means similar to those disclosed in U.S. Pat. No. 4,258,356 and copending application Ser. No. 853,778 previously cited and Interface 401 includes ROM 402 (mentioned earlier) and appropriate circuitry detailed in the patent and copending application identified immediately above which converts the resultant acoustic inputs into appropriate data signals in a parallel readout format suitable for directly driving Print Wheel 16 and other mechanical outputs, as detailed in the above-mentioned applications. A control signal indicating the availability of these data signals is sent directly to RAM 400 via line 403 (as stated earlier). A standard keyboard employing electrical switches throughout can be used instead; in this case Keyboard Interface Unit 401 would be of a more common variety.

Status RAM 400, already mentioned, is a register having sixty-four single-bit storage cells; it stores various flags indicating the status of an ongoing operation or any instruction for the machine to follow upon its usual interrogation rounds. RAM 400 is periodically polled or interrogated as part of the normal idling routine of the system in order to determine if any flags are set, and if set (or not set), the system will execute an appropriate subroutine. E.g., when Repeat Switch 408 is closed, an appropriate stage of RAM 400 will become set thereby to indicate that the machine should repeat an operation or enter a special subroutine, such as reverse tab. RAM 400 is polled via an address input from an address bus 418 which selects a desired stage in RAM 400. RAM 400 thereupon supplies a single output on line 454 indicating the status of the stage selected.

RAM 400 receives eleven control inputs. Four come directly from keys 12*a*, etc. or switches (e.g. 408) on an adjacent Keyboard 12, one (pitch selection) comes from a printed circuit board (not shown, but well known in the implementation of electrical circuits such as control circuit 28), one comes from the print wheel 16 to indicate a home position, two come from motors 11,13 as feedback signals in known fashion, and one (Left End) comes from a conventional limit switch actuated by Carrier 18 at the point of maximum leftward travel. The inputs are labeled and not all of these will be detailed since they are well-known to those skilled in the art.

As stated with regard to the Repeat Terminal input on lead 409 which is of most interest, when Tab Key 26 is deeply depressed, the voltage on lead 409 to RAM 400 will become active. In practice, the voltage on lead 409 is positive when inactive and falls to a ground level when active, i.e., when Repeat Switch 408 is closed. This is indicated in FIG. 4 by connection of lead 409 to positive voltage source 410 via resistor 412. The same circuit is associated with Tab Clear Key 24; it also operates Switch 408 by a bail, which can be the same bail as Bail 404. When Tab Clear Key 24 is shallow-depressed (Switch 408 still open), any tab setting at the carrier's present position will be cleared, and when Tab Clear Key is deep-depressed, all tab settings will be cleared regardless of the carrier's position.

Referring to the upper lefthand corner of FIG. 4, a Dead Key and Hammer Energy Latch and ROM 420 has 256 stages of three bits each. It receives information from a data bus 422, specifically it receives processed key information from a FIFO (first-in-first-out) register 414A and latches (stores) this key information. The stored key information is read when needed to determine if the key is a "dead key" (i.e., Carrier 18 does not advance after printing the key's character, such as a letter which is to have an accent mark typed over it) and also to determine which of four possible hammer energies to use when printing the character—e.g., less energy would be used to print a character with a small area, such as a period ("."), than a character with a large area, such as a "W".

Arithmetic Logic Unit (ALU) 424 receives information from data bus 422 and Accumulator 416, already mentioned. It performs simple arithmetic and logical (comparison) operations, such as the AND and OR functions, addition, subtraction, division, etc. when these operations are required by the system. For example, using ALU 424, the existing number of spaces from the lefthand margin at which Carrier 18 is presently positioned can be added with a number representing any incremental movement of Carrier 18 in order to provide a sum equal to the new position of Carrier 18. ALU 424 also makes appropriate computations to control the carrier return position and computations to calculate the shortest possible path and corresponding direction of rotation when Print Wheel 16 is to be rotated from one character to another character. ALU 424 supplies a data output to Accumulator 416 and a control output to an Instruction Disable Unit (IDU) 426. The control output to IDU 426 can be either a carry, greater than, or "equal" output to indicate the result of a comparison in ALU 424.

Accumulator 416 is a temporary storage register which, e.g., holds information being worked on by ALU 424, in well-known fashion. As indicated, Accumulator 416 receives and supplies information to data bus 422 and ALU 424.

Instruction Disable Unit (IDU) 426 receives inputs from ALU 424 and Status RAM 400 and, according to the input received, can supply a "skip" input to an Instruction Decoder 428 which causes a Program Counter 430 to increment one extra count. I.E., when ALU 424 supplies a comparison ("carry," "greater than" or "equal") output, or when Status RAM 400 supplies an output—indicating a set (true) or non-set (false) flag—IDU 426 can supply a skip signal to Decoder 428 in accordance with the state of the particular output which will in turn cause the next sequential instruction to be skipped. Thus IDU 128 can effect a skip or not as to the result of a comparison or a flat test.

Data Storage RAM 414, already mentioned, has registers which hold variable data, i.e., it has a FIFO (first-in-first-out) Register (A) for storing characters corresponding to keys actuated but not yet printed, a Correction Register (B) for storing the last group (ten in one embodiment) of keys actually typed, a Carrier Space Count Register (C), a Carrier Present Position Register (D), Left and Right Margin Registers (E), a Carrier Desired Position Register (F), a Tab Stop Register (G) which, as mentioned, has sixteen seven-bit cells for storing tab stop settings, a Tab Pointer Register (H), a New Key Register (I), a Print Wheel Step Count Register (J), FIFO Pointers (K1, K2) and other registers not relevant to the present invention. RAM 414 can be considered as having sixty-four locations, each capable of holding seven bits of information. Some of Registers 414A to 414K correspond to respective locations, while others, such as Correction Register (B) and Tab Stop Register (G), require several locations. In well-known fashion, the information in any selected register in RAM 414 can be read out by providing an appropriate address input on an Address Bus 418 and applying an appropriate and well-known control or read input (not shown) from Decoder 428 to enable the data to be read into or out of RAM 414 via Data Bus 422 leading from its right side.

Address Latch 432 receives an address from a current instruction being executed and holds it so that such address can be supplied to RAM 414 (via a Decoder 434) for enough time for data to be read out or written at the appropriate point in RAM 414, in well-known fashion. Latch 432 supplies the six bits of the address to Decoder 434.

Decoder 434 operates to select or enable one address in RAM 414 or RAM 400 (one of sixty-four stages) at which to write in or read out information.

Storage Register 436 is used for subroutines; it stores the information word from Program Counter 430 to which to return after the subroutine is completed. Register 436 has three stages of eleven bits each.

Program Counter 430 causes the system to operate in accordance with the instructions on the flow chart by supplying appropriate addresses to a Program ROM 438. Program Counter 430 tends to supply sequential addresses, but works in association with Storage Register 436 such that when the machine is ready to call any subroutine, the current address or count in Program Counter 430 will be stored in Register 436. After the subroutine is completed, the stored address in Register 436 will be returned to Counter 430 so that it can cause the machine to resume its regular routine of operation. Also, as stated in the discussion of IDU (Instruction Disable Unit) 426, an address in Counter 430 can be skipped if IDU 426 causes Instruction Decoder 428 to increment Program Counter 430 a second time. Counter 430 also can be set to any address by an unconditional branch instruction: this will cause eleven address bits in an Instruction Latch 440 to be passed around on Address Bus 442 through Storage Register 436 and then to Counter 430, where they will be latched.

Program ROM 438 contains the actual program of the system, i.e., in response to sequential or other address inputs from Counter 430, it delivers appropriate instruction words (each having an address or data and operation code) which cause the machine to operate in accordance with the flow chart of FIG. 3. For example, Program ROM 438 selects appropriate stages of Status RAM 400 in order to determine whether certain flags are set at appropriate times. Program ROM 438 contains an Input Decoder and Drivers and Output Drivers, as indicated. ROM 438 has 1536 stages of thirteen bits each.

Instruction Latch 440 holds the instruction word of Program ROM 438 currently being executed, in well-known fashion.

Instruction Decoder 428 receives the output of Latch 440. Decoder 428 is a ROM which controls the actual physical operation of the machine by gating information in and out of various units of the machine via the bus lines, under control of Program ROM 438. As stated previously, Decoder 428 can also cause an instruction to be skipped in response to the skip signal from IDU 426. The output or control lines of Decoder 428 are merely indicated by arrows in FIG. 4 because their connections are well-known and including them would make the figure less easy to follow.

Buffer 444 is a tri-state device, i.e., it can supply a binary ONE output, a binary ZERO output, or provide a high input-to-output impedance. It connects address bus 442 on its left side to the outputs of the machine and also connects data into RAM 414 via data bus 422.

Clock and Power On Reset Generator 446 provides the master clock pulses for the machine and also resets all the registers of the machine (power on reset) when the machine is first turned on. For purposes of simplification and ease of illustration, the various outputs of Generator 446, which lead to most of the blocks in the figure, are not shown, but the connections are well-known to those skilled in the art.

Also not shown is a conventional timer unit for providing various time delays, when required by operation of the machine. Further, a conventional power supply and biasing network for energizing the various circuits (e.g., the source 410 supplying voltage +V, as previously mentioned) is not shown either, but typical details are given in the copending applications referenced earlier.

Miscellaneous Output Register and Drivers 448 provides outputs to drive various conventional functions of the machine, such as the print hammer 17, a warning tone to indicate the right margin is being approached, a linefeed to rotate Platen 14, a print or correct ribbon lift control, detents for Print Wheel 16 and Carrier 18 which hold these elements in a fixed position when not in use, and various indicator lights as noted at 447 in FIG. 4.

Carrier Decoder and Driver Register 450 drives Motor 13 which controls the horizontal position of Carrier 18, by interpreting the instruction bits supplied on Data Bus 422 from ROM 438 to select appropriate windings for causing Carrier 18 to move either to the right or to the left, in increments. When a tab move is called, data will be supplied to Register 450 so as to cause Carrier Motor 13 to move to the next tab stop at either left or right, in accordance with the depth of depression of Tab Key 26.

Print Wheel Decoder and Driver Register 452 controls Motor 11 which rotates Print Wheel 16, thereby to select appropriate characters to be typed. When a character is called, data will be supplied to Register 452 so as to cause the print wheel motor 11 to rotate wheel 16 to the selected character.

FIGS. 3 AND 4—OPERATION

The system of FIG. 4 implements the flow chart operations of FIGS. 3A and 3B in the following manner:

When Tab Key 26 on Keyboard 12 is depressed deeply, the tab input is coded—as by an acoustic signal to the previously-mentioned circuitry (not shown) to generate the Tab Key code in ROM 402—and, due to actuation of Switch 408 by common bail 404, the Repeat Terminal lead 409 to Status RAM 400 goes active (to ground). When the code is available, a signal is sent on line 403, and immediately sets the Key-Waiting Flag of Status RAM 400. Likewise, the active state of Repeat Terminal lead 409 immediately sets the Repeat Terminal Flag in Status RAM 400, as stated previously.

As part of its routine interrogation rounds, the machine will then test selected flags in RAM 400—e.g., the Key Waiting Flag, and since this was set by a key actuation on Keyboard 12, the corresponding code from ROM 402 will be entered into FIFO Register 414A. The key codes in FIFO Register 414A will be processed—in order of their entry into FIFO 414A—by transferring the key codes from Register 414A to New Key Register 414I and then to Accumulator 416. When the tab key code is transferred in its turn to New Key Register 414I and Accumulator 416, that code will be identified as a function code and the value in Accumulator 416 then compared for equality with a series of function key codes obtained from Program ROM 438 in a preselected sequence. When the value in Accumulator 416 is eventually compared with the tab code (binary code for decimal 115), equality will exist (Yes output of Box 62), and ALU 424 will provide a "true" signal on its "equal" output line (FIG. 4) to IDU 426. As a result, in accordance with previous description, instead of causing a skip, the output of IDU 426 will cause Instruction Decoder 428 to advance Program Counter 430 to address the next sequential instruction in ROM 438, which is an unconditional branch. The machine will thus jump to the tab subroutine, as explained in more detail below and as defined in the subsequent blocks of FIG. 3B.

Note that the above-mentioned tests of the value in Accumulator 416 (tab code) against other function codes gave rise to "false" signals on the "equal" output line of ALU 424 and, under control of IDU 426 and Decoder 428, these generated skip inputs to Program Counter 430 which caused each associated unconditional branch to be bypassed in the fashion previously described and known in the art.

More particularly, the above-mentioned no-skip causes a "branch-to-tab" instruction. This is accomplished by transferring that instruction which is at the next sequential address in Program ROM 438 to Instruction Latch 440. This will, in turn, cause the count in Program Counter 430 to be abruptly changed ("jumped") to the particular address for the start of the tab subroutine (Box 66). This is done by passing the eleven least significant bits in Latch 440 (which latched the unconditional branch instruction, including the particular address indicated by these bits) through Storage Register 436 and into Program Counter 430. Counter 430 now addresses the initial portion of the tab program stored in Program ROM 438—i.e., that portion associated with Box 66. Execution of this portion of the program proceeds as follows:

The first decision to be made (Box 66) is to determine whether the left margin setting (in a Left and Right Margin Register 414E) is greater than the setting in the Carrier Present Position Register 414D. This test is accomplished by a count comparison in ALU 424. If, as is usual, the left margin reading is not greater than the carrier present position, ALU 424 will provide a "false" input to IDU 426, which will then supply a skip input to Decoder 428. Program Counter 430 then will be caused to increment by one extra count so that it addresses the next sequential instruction in Program ROM 438 (the instruction after the unconditional branch). In response to the new instruction, the six least significant bits in Latch 440 are put onto Data Bus 422 via Buffer 444 and these bits are held in Address Latch 432. This group of bits or address in Latch 432 is then decoded by Decoder 428 which selects one of the locations in Status RAM 400. As indicated in Box 72, the address selected is that of the Margin Release Flag and that stage is thereupon set in known fashion to permit direct tabbing to any tab stops at right of the right margin.

Before continuing with the normal routine, note that if the left margin setting is greater than the carrier present position, ALU 416 will detect a "greater than" and send a "true" input to IDU 426, which last will *not* cause a skip input to be sent to Decoder 428. Accordingly, the very next instruction of the sequence, an unconditional branch, will be executed. As a result, Program Counter 430 will be set—via Storage Register 436, as explained previously—to the address in Latch 440 corresponding to the start of the program section associated with Box 68. Execution of this portion of the program then proceeds, i.e., the Carrier Desired Position Register 414F will be set to the value stored in the Left Margin Register (part of 414E), and a forward move of Carrier 18 to the left margin executed (Box 70) in steps not relevant here.

Then (Box 74), a check is made to see if the Reverse Tab Mode Flag is set. The address of this flag in RAM 400 is selected by the six least significant bits of the instruction in Latch 440, which are transferred to Latch 432 via Buffer 444 and Data Bus 422 and decoded by Decoder 428, in the fashion described previously with respect to the Margin Release Flag (Box 72). If the flag is set, the output of Status RAM 400 will be true, and an appropriate input will be sent IDU 426 which will in turn *not* provide a skip input to Instruction Decoder 428 so that the next instruction will not be skipped, but will be addressed and fetched in sequence by Program Counter 430. This will be an unconditional branch instruction, which will cause Program Counter 430 to be set to the address of the start of the program section associated with Box 90 (the next operation, since the Yes output of Box 74 bypassed Boxes 76 and 88). For this purpose, the eleven least significant bits in Instruction Latch 440 (which latched the unconditional branch instruction) are again passed through Storage Register 436 and loaded into Program Counter 430. The Program Counter 430 now addresses the start of the reverse subroutine (in ROM 438) and execution of this portion of the program accordingly proceeds.

If, on the other hand, the output of Status RAM 400 is false—i.e., the Reverse Tab Mode Flag is not set—IDU 426 will provide a skip input to Instruction Decoder 428 which will cause (as above) Program Counter 430 to increment by one extra count. The Program Counter 430 then addresses the instruction in Program ROM 438 sequentially following the next or unconditional branch instruction. The unconditional branch instruction has, therefore, been skipped. Execution of the "skip on false flag" instruction is completed at this point.

The Repeat Flag is then checked (Box 76) in the same fashion as the Reverse Tab Mode Flag was checked (Box 74). If the Repeat Flag is clear, as it will be initially because of the sequence of the signals obtained upon deep depression of Tab Key 26, a forward tab move operation is initiated (Box 77), but if the Repeat Flag has been set, the operations in Box 88 will proceed, under the aforedescribed steps in which a skip input is *not* generated and the very next instruction in the tab program sequence is followed, giving rise to a jump in the setting of Program Counter 430.

The program proceeds as indicated with operations in rectangular boxes being carried on according to straight-forward sequential program commands (generally, and excepting jumps for returning to the main program path) and decisions in diamond boxes being selectively implemented by presence or absence of a skip input from IDU 428 under control of the output of ALU 424 or an input from Status RAM 400.

Moving down to Boxes 120, 122 and 124, these depict the first reverse actions as a result of the reverse tab subroutine, which actions depend on the state of the linefeed flag. As seen in Box 120, if the flag is set (true, or "yes"), the response is a left move routine including a linefeed (Box 122) because Platen 14 is to index one line. This response does not require branching because only a single step is required: an appropriate command is sent to Miscellaneous Output Register and Drivers 448 which activates, for example, the linefeed drive motor (not shown, but is a conventional element of the LINEFEED DRIVE forming part of the miscellaneous outputs listed in Box 447 of FIG. 4). Activation is for a fixed time (the timer—a conventional unit sufficing, as stated earlier—having been reset in Box 119, as previously mentioned) to operate properly a cam mechanism (also not shown as it too may be part of the above-mentioned conventional LINEFEED DRIVE for platen drive. Preferably, though, the linefeed motor and cam mechanism are the ones detailed in the previously-mentioned U.S. Pat. No. 4,365,904 granted Dec. 28, 1982, to Hans W. Mueller et al., entitled "Linespacing Apparatus."

Since activation of the linefeed drive motor is for a fixed time, completion of linefeed is not required before proceeding, so with substantially negligible delay, the next sequential instruction is fetched and it (together with others following it) causes Carrier 18 to be moved in the left direction by the desired amount (Box 124 in accordance with Box 116). Appropriate instructions are provided to Carrier Decoder and Driver Register 450 from Buffer 444 under control of Instruction Decoder ROM 428. If the operation of Box 122 is bypassed (by virtue of a skip input of the type described previously), the same carrier move is effected, but without the linefeed, because the same point in the program is reached in either case.

After the action in Box 126 (described above) the reverse tab move will be complete. Note particularly that the clearance (Box 126) is effected in essentially the same sequence as the setting of the Margin Release Flag (Box 72) except that a zero is written in the cell of Status RAM 400 corresponding to the Linefeed Flag.

Although a complicated and relatively lengthy sequence of operations was described, due to the high clock rate of operation of the electronic system, these moves take place very rapidly when Tab Key 26 is depressed or is deep-depressed.

While the above description contains many specifities, these should not be considered as limiting the scope of the invention since many ramifications of the embodiment described will be apparent to those skilled in the art. For example, in the reverse tab operation described, a first deep depression of Tab Key 26 causes a reverse tab motion plus a linefeed or index, and subsequent shallow depression of Tab Key 26 causes a reverse tab operation only. This mode of operation can be implemented mechanically in a non-electronic typewriter by providing a linefeed upon a first reverse tab operation and by providing an appropriate mechanism to prevent linefeed upon subsequent reverse tab operations. The "anti-linefeed-upon-subsequent-reverse-tabs" mechanism would be cleared upon operation of any character or space key. Also while the tab and reverse tab operations were operated by a single Tab Key 26, it will be apparent that a separate reverse tab key can be provided, in which case the reverse tab key would have only two positions, i.e., off and on; in the on position the tab activate input to ROM 402 and the actuation of Repeat Switch 408 of FIG. 5 would occur. Many variations in the rules for entering reverse tab, especially in association with the margins, can be made within the scope of the invention. Also, in lieu of making a forward tab move first, the machine can alternatively go directly into the reverse tab movement upon activation of the reverse tab function, say by introduction of sufficient delay to permit sensing subsequent closure of Switch 408 during tab key depression, although this is not preferred because of possibly noticeable dely accompanying the more frequently used forward tab moves. Accordingly it is therefore desired that the true scope of the invention be determined only according to the appended claims and their legal equivalents.

I claim:

1. A tab control system for a typewriter comprising a keyboard containing character keys; type elements and a carrier therefor; mechanical striking means attached to said carrier and capable of striking said type elements against a platen in accordance with characters selected on said keyboard; said carrier, said mechanical striking means, and said type elements being arranged to move axially with respect to said platen, said carrier also being arranged to move a predetermined distance in a predetermined direction with the striking of any character of said type element means against said platen, said keyboard having:

(a) tab set means for manually presetting a plurality of tab stop positions of said carrier with respect to said platen, (b) tab clear means for manually clearing any of said plurality of said tab stop positions, when set, (c) tab actuating means responsive to a first kind of manual actuation thereof for moving said carrier to any of said plurality of preset tab stop positions, said system including tab control means for moving said carrier from its present position to the closest preset tab stop position in said predetermined direction upon each manual actuation of said tab actuating means, said tab control means also being arranged to move said carrier to the closest predetermined tab position in a direction opposite to said predetermined direction and for rotating said platen through a predetermined angle so as to cause any type-receiving medium positioned around said platen to move to a lower line position with respect to said carrier, upon a second kind of manual actuation of said tab actuating means, and for moving said carrier to the closest predetermined tab position in said opposite direction and without rotating said platen, upon each manual actuation of said tab actuating means directly after said second kind of manual actuation thereof.

2. The tab control system of claim 1 wherein said tab actuating means comprises a single tab key on said keyboard, said tab control means being normally arranged to actuate said move of said carrier in said predetermined direction upon a shallow depression of said tab key and said opposite movement of said carrier upon a deep depression of said tab key, said deep depression of said tab key being said second kind of manual actuation thereof, and wherein said tab control means is arranged to actuate said opposite movement of said carrier upon any shallow depressions of said tab key thereof following any deep depression thereof.

3. The tab control system of claim 2 wherein said tab actuating means is arranged to provide a first output from said keyboard upon a shallow depression of said tab key, and a combination of said first output and a second output from said keyboard upon a deep depression of said tab key.

4. The tab control system of claim 3 wherein said second output is a keyboard control function which actuates a function of said typewriter other than said tab function when said tab function is not being operated.

5. The tab control system of claim 1 further including margin limit setting controls on said typewriter for limiting the leftmost and rightmost positions of said carrier with respect to said platen provided no margin release operation has been effected, and further including means for preventing a leftward movement of said carrier with respect to said platen if said carrier is positioned to the left of the leftmost margin limit position.

6. The tab control system of claim 1 wherein said typewriter comprises an electronic system responsive to outputs from said keyboard for generating control signals in accordance with keys actuated on said keyboard; said type element means, said carrier, and said mechanical striking means being responsive to said control signals for actuating operation thereof, said tab actuating means being arranged to provide a first electrical output upon shallow depression of a tab key on said keyboard and a combination of said first electrical output and a second electrical output upon deep depression of said tab key.

7. The tab control system of claim 1 wherein said tab control means is arranged to move said carrier in said predetermined direction to said closest preset tab position upon any manual actuation of said tab actuating means of said first kind after a manual actuation of a key on said keyboard other than said tab actuating means.

* * * * *